US007928923B2

(12) United States Patent
Udagawa et al.

(10) Patent No.: US 7,928,923 B2
(45) Date of Patent: Apr. 19, 2011

(54) ANTENNA ASSEMBLY AND METHOD FOR MANUFACTURING THE SAME

(75) Inventors: Shigeo Udagawa, Tokyo (JP); Satoshi Yamaguchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 196 days.

(21) Appl. No.: 11/995,340

(22) PCT Filed: Feb. 19, 2007

(86) PCT No.: PCT/JP2007/052981

§ 371 (c)(1),
(2), (4) Date: Jan. 11, 2008

(87) PCT Pub. No.: WO2007/119289

PCT Pub. Date: Oct. 25, 2007

(65) Prior Publication Data

US 2008/0224938 A1 Sep. 18, 2008

(30) Foreign Application Priority Data

Mar. 16, 2006 (JP) ..... 2006-072690

(51) Int. Cl.
*H01Q 1/52* (2006.01)

(52) U.S. Cl. ..... 343/841

(58) Field of Classification Search ..... 343/841, 343/789, 770, 786, 767, 768, 771, 772, 778
See application file for complete search history.

(56) References Cited

U.S. PATENT DOCUMENTS

| | | | | |
|---|---|---|---|---|
| 5,132,698 | A * | 7/1992 | Swineford | 343/846 |
| 5,426,442 | A * | 6/1995 | Haas | 343/778 |
| 5,995,058 | A | 11/1999 | Legay et al. | |
| 6,052,099 | A * | 4/2000 | Imaizumi et al. | 343/840 |
| 6,624,789 | B1 * | 9/2003 | Kangasvieri et al. | 343/702 |
| 7,295,165 | B2 * | 11/2007 | Ferguson et al. | 343/705 |

FOREIGN PATENT DOCUMENTS

| | | | |
|---|---|---|---|
| DE | 102 40 494 | A1 | 3/2004 |
| JP | 61-256801 | | 11/1986 |
| JP | 9-93031 | | 4/1997 |
| JP | 10 163737 | | 6/1998 |
| JP | 10 308628 | | 11/1998 |
| JP | 2002 374120 | | 12/2002 |
| JP | 2005-94537 | | 4/2005 |
| JP | 2005-244317 | | 9/2005 |
| SU | 148509 | A1 * | 4/1987 |
| SU | 1483509 | A1 | 5/1989 |

* cited by examiner

*Primary Examiner* — Jacob Y Choi
*Assistant Examiner* — Kyana R Robinson
(74) *Attorney, Agent, or Firm* — Oblon, Spivak, McClelland, Maier & Neustadt, L.L.P.

(57) ABSTRACT

In an antenna apparatus, at least one choke in the form of a groove is arranged between a transmitting antenna and a receiving antenna. The choke functions to suppress the mutual electromagnetic coupling between the transmitting antenna and the receiving antenna. The depth of the choke is in a range from 0.15, to less than 0.225λ where λ is a wavelength of a carrier wave.

14 Claims, 6 Drawing Sheets

ANTENNA ASSEMBLY AND METHOD FOR MANUFACTURING THE SAME

TECHNICAL FIELD

The present invention relates to an antenna apparatus in millimeter waveband or microwave band and a method of manufacturing the antenna apparatus.

BACKGROUND ART

When two antennas are near each other, coupling occurs between them. Such coupling can alter the directivity of the antennas thereby causing various problems in the operations of the host system. For example, in a radar system, detection of a target becomes very difficult if some of the transmitted electromagnetic waves directly leak into the receiving system. Hence, it is necessary to suppress occurrence of coupling between a transmitting antenna and a receiving antenna.

A conventional approach to suppress the amount of coupling between the antennas is to arrange a choke, which is in the form of a groove, between the antennas. Based on a result of a study that indicated that it is preferable that the impedance of the choke be infinite, in the conventional approach the groove with the depth of 0.25λ is employed, wherein λ is the wavelength of a carrier wave (refer to Patent Document 1).

Patent Document 1: Japanese Patent Application Laid-Open No. H10-163737

DISCLOSURE OF INVENTION

Problem to be Solved by the Invention

However, in practice, even if the groove is 0.25λ deep, some coupling still occurs between the transmitting antenna and the receiving antenna. To enhance the choke effect by the groove, one approach is to provide a plurality of grooves. However, if the transmitting antenna and the receiving antenna are arranged very close to each other, then there is a restriction on the number of grooves that can be formed.

The present invention aims to solve the above problems and provide an antenna apparatus that includes at least one choke in the form of a groove such that the amount of coupling between a transmitting antenna and a receiving antenna can be reduced as compared to that in conventional technology, and a method of manufacturing the antenna apparatus.

Means for Solving Problem

An antenna apparatus in millimeter waveband or microwave band according to an aspect of the present invention includes a ground conductor; a first antenna arranged on the ground conductor and directly connected to a feed line; a second antenna arranged on the ground conductor, connected to another feed line, and arranged at such a distance from the first antenna that there is a possibility of mutual electromagnetic coupling occurring with the first antenna; and a choke in a form of a groove that is arranged between the first antenna and the second antenna, and is operative to suppress the mutual electromagnetic coupling between the first antenna and the second antenna, and has a depth in a range from 0.15 times to less than 0.225 times of a wavelength of a carrier wave.

EFFECT OF THE INVENTION

An antenna apparatus in millimeter waveband or microwave band according to an aspect of the present invention includes a ground conductor; a first antenna arranged on the ground conductor and directly connected to a feed line; a second antenna arranged on the ground conductor, connected to another feed line, and arranged at such a distance from the first antenna that there is a possibility of mutual electromagnetic coupling occurring with the first antenna; and a choke in a form of a groove that is arranged between the first antenna and the second antenna, and is operative to suppress the mutual electromagnetic coupling between the first antenna and the second antenna, and has a depth in a range from 0.15 times to less than 0.225 times of a wavelength of a carrier wave. Therefore, amount of electromagnetic coupling between a first antenna and a second antenna can be suppressed.

EXPLANATIONS OF LETTERS OR NUMERALS

1 First antenna
1*a* First-antenna aperture
2 Second antenna
2*a* Second-antenna aperture
3 Ground conductor

4 Choke
4*a* Choke
4*b* Choke
4*c* Choke-4 slit or choke-4*a* slit and choke-4*b* slit
5*a* First steel plate
5*b* Second steel plate

BEST MODE(S) FOR CARRYING OUT THE INVENTION

Exemplary embodiments for an antenna apparatus and a method of manufacturing the antenna apparatus according to the present invention will be described below in detail with reference to the accompanying drawings. The present invention is not limited to the embodiments described below.

First Embodiment

Figure 1:
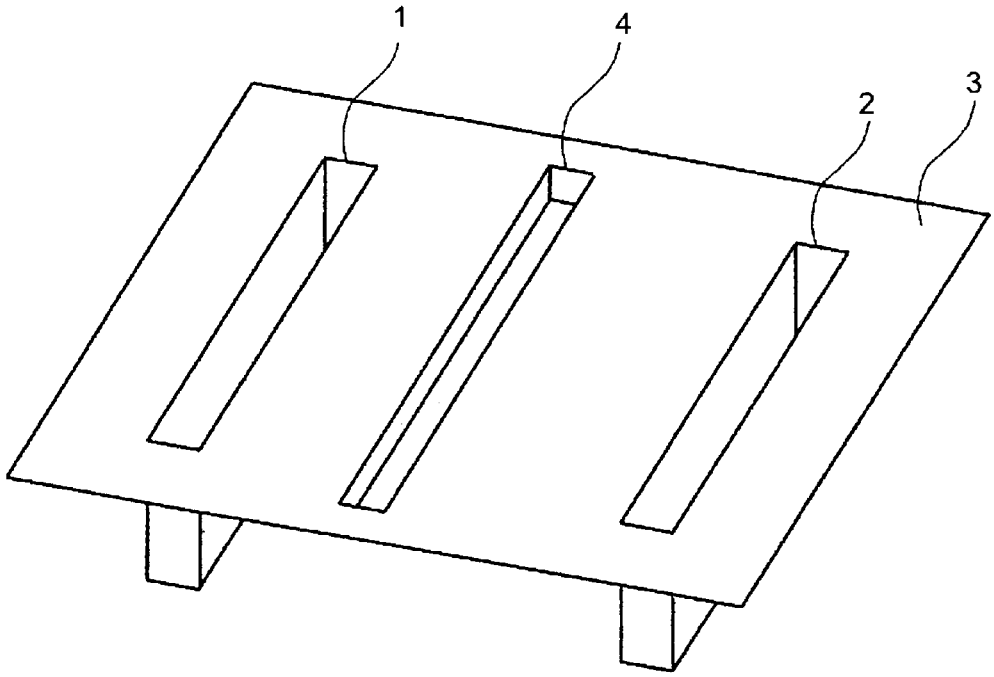
FIG. 1 is a perspective view of an antenna apparatus according to a first embodiment of the present invention.

FIG. 1 is a perspective view of an antenna apparatus according to a first embodiment of the present invention.

The antenna apparatus in FIG. 1 includes a first antenna 1, a second antenna 2, a ground conductor 3, and a choke 4 that is arranged between the first antenna 1 and the second antenna 2. In the first embodiment, the first antenna 1 is assumed to function as a transmitting antenna, while the second antenna 2 is assumed to function as a receiving antenna.

Figure 2:
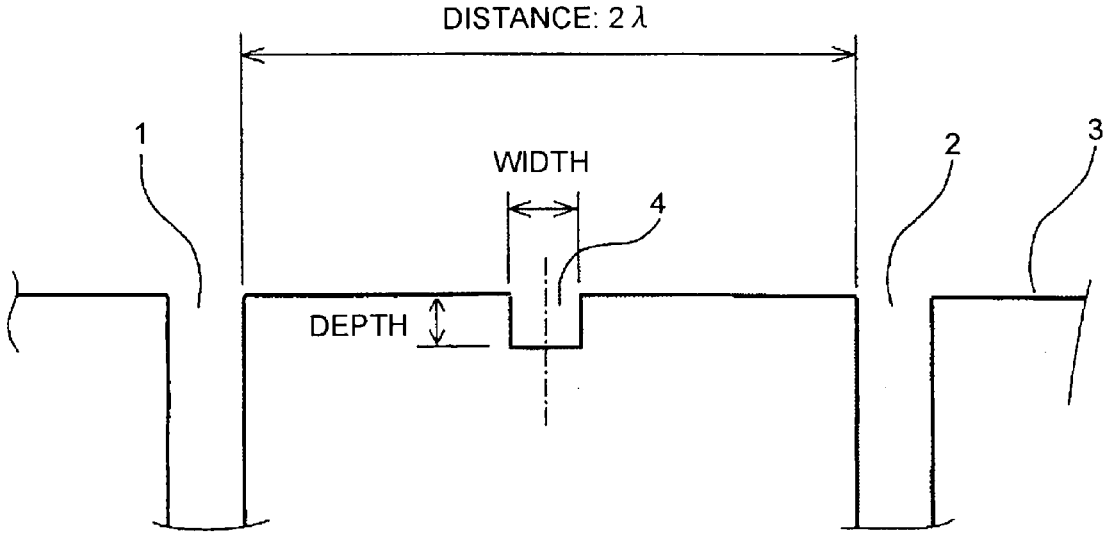
FIG. 2 is a side view of the antenna apparatus according to the first embodiment of the present invention.

FIG. 2 is a side view of the antenna apparatus according to the first embodiment of the present invention. Assuming that the wavelength of a carrier wave is λ, the distance between the first antenna 1 and the second antenna 2 is 2λ. However, the distance between the first antenna 1 and the second antenna 2 is not limited to an integral multiple of the wavelength λ. When the first antenna 1 and the second antenna 2 are arranged so near each other, electromagnetic coupling occurs between them. That is, some of the electromagnetic waves transmitted from the first antenna 1 directly leak into the second antenna 2. To suppress the amount of coupling between the first antenna 1 and the second antenna 2, the choke 4 is arranged between the first antenna 1 and the second antenna 2. Usually, assuming that the wavelength of the carrier wave is λ, the choke 4 is made 0.25λ deep. However, depending on the specifications of different products, the amount of coupling suppressed by arranging the choke 4 may not be sufficient.

Hence, as shown in FIG. 2, an investigation was conducted in which certain parameters where varied to evaluate the amount of coupling between the first antenna 1 and the second antenna 2. The parameters used for the investigation were the width (which was varied in the range from 0.15λ to 0.3λ) and the depth (which was varied in the range from 0.1λ to 0.3λ) of the choke 4.

Figure 3:
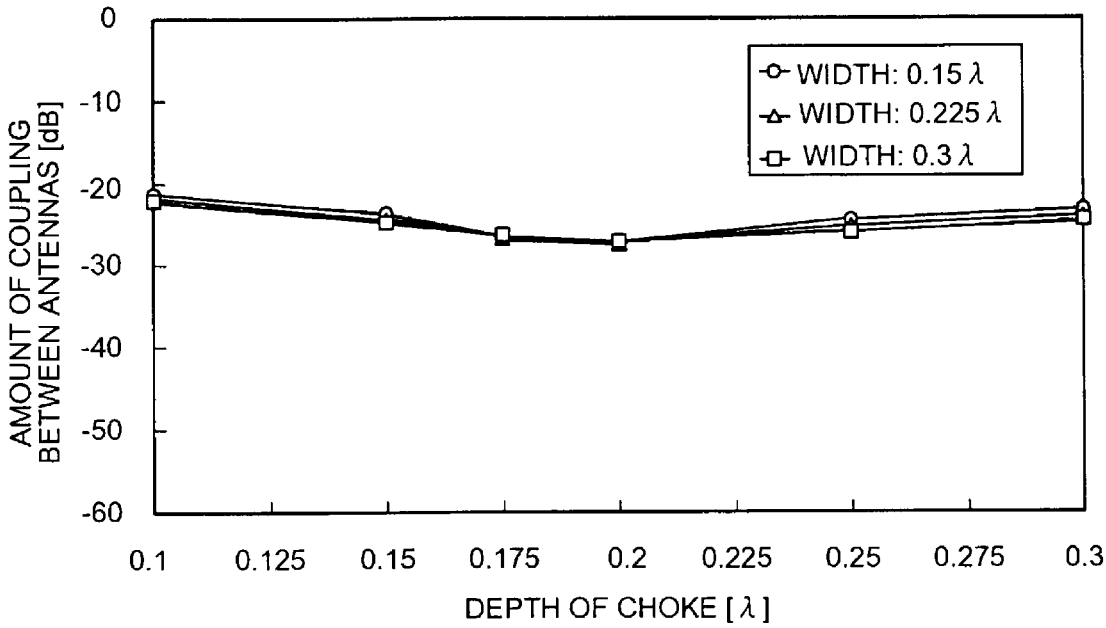
FIG. 3 is a graph depicting the variation in the amount of coupling that occurs between a first antenna 1 and a second antenna 2 depending on the width and the depth of a choke 4 functioning as parameters in the antenna apparatus according to the first embodiment of the present invention.

FIG. 3 is a graph depicting the variation in the amount of coupling that occurs between the first antenna 1 and the second antenna 2 depending on the width and the depth of the choke 4 functioning as the parameters in the antenna apparatus according to the first embodiment of the present invention. The horizontal axis represents the depth of the choke 4, while the vertical axis represents the amount of coupling between the first antenna 1 and the second antenna 2. A solid line with circles represents a graph when the width of the choke 4 is 0.15λ. A solid line with triangles represents a graph when the width of the choke 4 is 0.225λ. A solid line with squares represents a graph when the width of the choke 4 is 0.3λ.

It can be observed from FIG. 3 that the amount of coupling does not vary much depending on the width of the choke 4. On the other hand, the amount of coupling is suppressed to minimum when the depth of the choke 4 is 0.2λ, which is less than 0.25λ that was conventionally considered to be the depth of a choke at which minimum coupling is achieved. That is, if the depth of the choke 4 is in the range from 0.15λ to less than 0.25λ, the amount of coupling is less than when the depth of the choke 4 is 0.25λ that was conventionally considered to be the depth of a choke at which minimum coupling is achieved. Because the approach to make the choke 0.25λ deep is known, the suppression of coupling in the antenna apparatus according to the present invention is effectively achieved when the depth of the choke 4 is less than 0.225λ. When such configuration is implemented in an antenna apparatus that is located in a vacuum or air and employs a millimeter-wave-band of 76 gigahertz, it is preferable that the depth of the choke 4 be in the range from about 0.6 mm to 0.9 mm.

Given below is the reason why it is advantageous that the depth of the choke 4 be 0.2λ instead of the conventional value of 0.25λ.

Two types of coupling occur between the first antenna 1, which is the transmitting antenna, and the second antenna 2, which is the receiving antenna. First type of coupling occurs due to the surface current flowing through the ground conductor 3, while the second type of coupling occurs due to the electromagnetic waves propagating through the air.

When the depth of the choke 4 is 0.25λ as in the conventional approach, the coupling that occurs due to the surface current flowing through the ground conductor 3 can be suppressed effectively; however, the coupling that occurs due to the electromagnetic waves propagating through the air can be suppressed only to a limited extent.

On the other hand, when the depth of the choke 4 is 0.2λ, the coupling that occurs due to the surface current flowing through the ground conductor 3 is suppressed to a lesser extent than when the depth of the choke 4 is 0.25λ as in the conventional approach. However, comprehensive suppression can be achieved in case of the coupling that occurs due to the electromagnetic waves propagating through the air, and in case of the combination of the coupling that occurs due to the surface current flowing through the ground conductor 3 and the electromagnetic waves propagating through the air.

Figure 4:
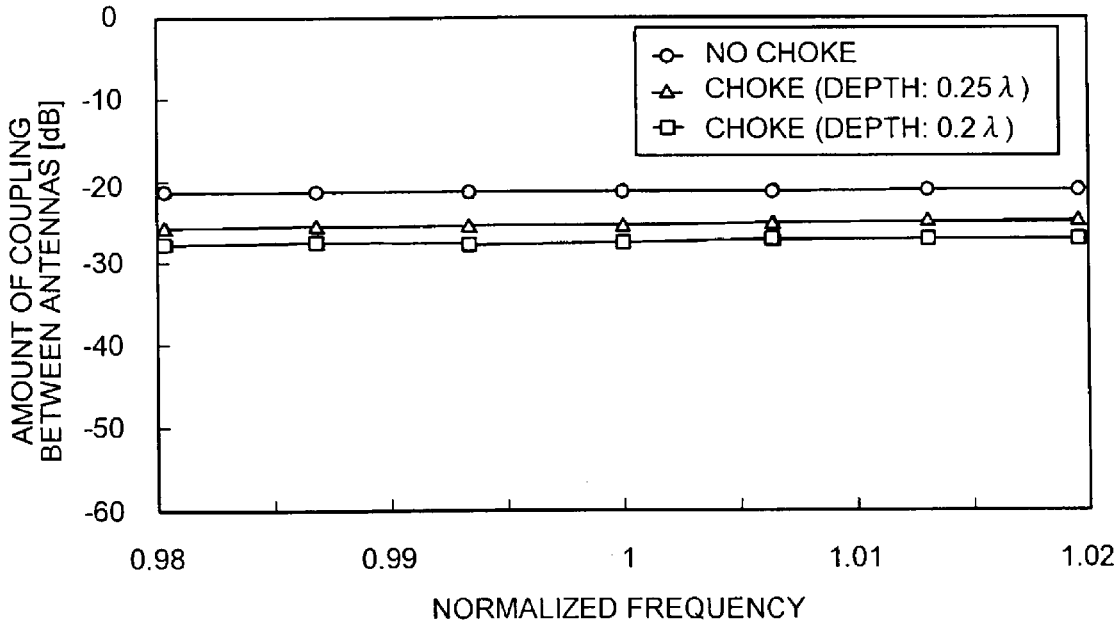
FIG. 4 is a graph depicting the variation in the amount of coupling that occurs between the first antenna 1 and the second antenna 2 depending on the depth of the choke 4 functioning as a parameter in the antenna apparatus according to the first embodiment of the present invention.

FIG. 4 is a graph depicting the variation in the amount of coupling between the first antenna 1 and the second antenna 2 depending on the depth of the choke 4 as the parameter in the antenna apparatus according to the first embodiment of the present invention. The width of the choke 4 is 0.225λ. The horizontal axis represents a normalized frequency, while the vertical axis represents the amount of coupling between the first antenna 1 and the second antenna 2. A solid line with circles represents a graph when no choke is arranged between the first antenna 1 and the second antenna 2. A solid line with triangles represents a graph when the choke 4 having the depth of 0.25λ is arranged. A solid line with squares represents a graph when the choke 4 having the depth of 0.2λ is arranged.

As shown in FIG. 4, when no choke is arranged between the first antenna 1 and the second antenna 2, the amount of coupling between the first antenna 1 and the second antenna 2 is about −22 dB. When the choke 4 having the depth of 0.25λ, is arranged, the amount of coupling between the first antenna 1 and the second antenna 2 is less by about −4 dB than when no choke is arranged. Moreover, when the choke 4 having the depth of 0.2λ, is arranged, the amount of coupling between the first antenna 1 and the second antenna 2 is less by about −2 dB than when the choke 4 having the depth of 0.25λ is arranged.

The horizontal axis in FIG. 4 represents the normalized frequency. When the normalized frequency is implemented in, e.g., an antenna apparatus in a millimeter-wave automotive radar and having a central frequency of 76.5 gigahertz, suppression of the coupling can be achieved in the range from about 75 gigahertz to about 78 gigahertz.

To sum up, the antenna apparatus includes the ground conductor 3, the first antenna 1 arranged on the ground conductor 3 and connected to a first feed line, the second antenna 2 also arranged on the ground conductor 3 and connected to a second feed line, and the choke 4 arranged between the first antenna 1 and the second antenna 2. The first antenna 1 and the second antenna 2 are arranged at such a distance that mutual electromagnetic coupling may occur between them. The choke 4 is in the form of a groove arranged on the ground conductor 3 and it functions to suppress the mutual electromagnetic coupling between the first antenna 1 and the second antenna 2. The depth of the groove is in the range from 0.15 times to less than 0.225 times of the wavelength of the carrier wave. Because of such a configuration, the electromagnetic coupling between the first antenna 1 and the second antenna 2 can be suppressed effectively.

Second Embodiment

As described in the first embodiment, one choke 4 was arranged between the first antenna 1 and the second antenna 2. Given below is the description according to a second embodiment of the present invention in which two chokes 4 are arranged between the first antenna 1 and the second antenna 2. The reference numerals of the components are identical to those used in the first embodiment.

Figure 5:
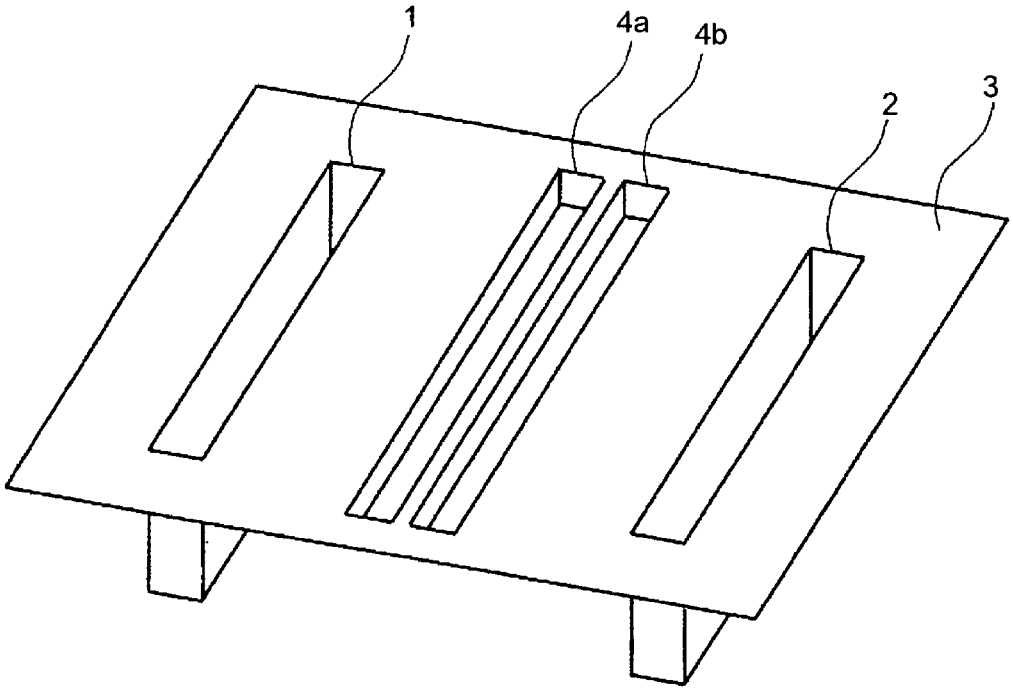
FIG. 5 is a perspective view of an antenna apparatus according to a second embodiment of the present invention.

FIG. 5 is a perspective view of an antenna apparatus according to the second embodiment of the present invention.

As shown in FIG. 5, two chokes 4: a choke 4*a* and a choke 4*b*, are arranged between the first antenna 1 and the second antenna 2.

Figure 6:
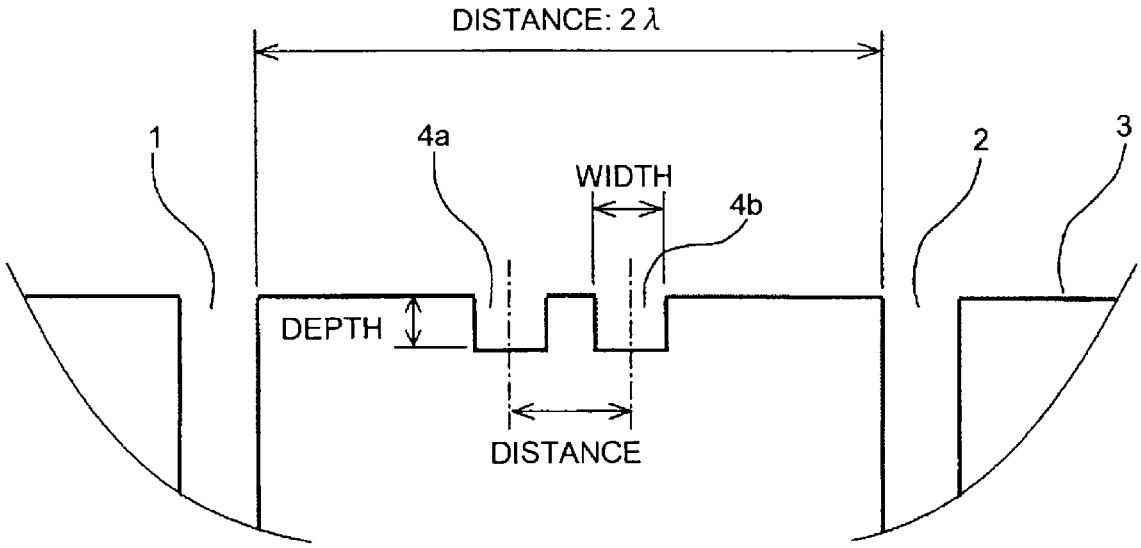
FIG. 6 is a side view of the antenna apparatus according to the second embodiment of the present invention.

FIG. 6 is a side view of the antenna apparatus according to the second embodiment of the present invention. As shown in FIG. 6, the choke 4*a* and the choke 4*b* are arranged such that the coupling between the first antenna 1 and the second antenna 2 is suppressed. Usually, assuming that the wavelength of a carrier wave is λ, the choke 4*a* and the choke 4*b* are made 0.25λ deep.

An investigation was conducted in which certain parameters where varied to evaluate the amount of coupling between the first antenna 1 and the second antenna 2. The parameters used for the investigation were the width (which was varied in the range from 0.15λ to 0.3λ) and the depth (which was varied in the range from 0.1λ to 0.3λ) of the choke 4*a* and the choke 4*b*, and the distance between the choke 4*a* and the choke 4*b* (which was varied in the range from 0.25λ to 0.5λ). The choke 4*a* and the choke 4*b* had the same width and the same depth.

Figure 7:
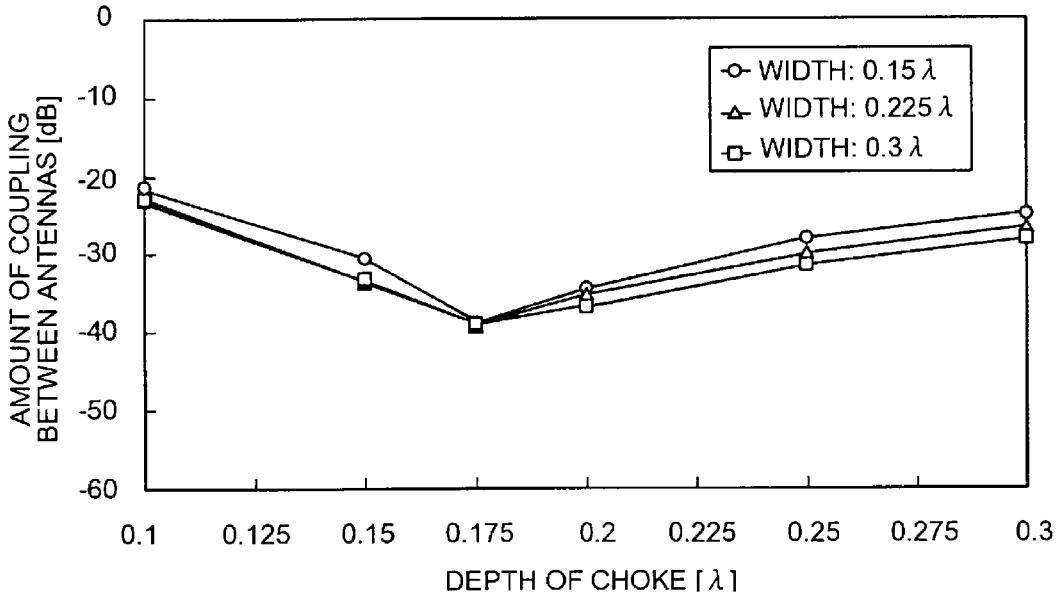
FIG. 7 is a graph depicting the variation in the amount of coupling that occurs between the first antenna 1 and the second antenna 2 depending on the width and the depth of a choke 4*a* and a choke 4*b* functioning as parameters in the antenna apparatus according to the second embodiment of the present invention.

FIG. 7 is a graph depicting the variation in the amount of coupling between the first antenna 1 and the second antenna 2 depending on the width and the depth of the choke 4*a* and the choke 4*b* as the parameters in the antenna apparatus according to the second embodiment of the present invention. The horizontal axis represents the depth of the choke 4*a* and the choke 4*b*, while the vertical axis represents the amount of coupling between the first antenna 1 and the second antenna 2. A solid line with circles represents a graph when the width of the choke 4*a* and the choke 4*b* is 0.15λ. A solid line with triangles represents a graph when the width of the choke 4*a* and the choke 4*b* is 0.225λ. A solid line with squares represents a graph when the width of the choke 4*a* and the choke 4*b* is 0.3λ. In the example shown in FIG. 7, the distance between the center of the choke 4*a* and the center of the choke 4*b* was 0.375λ.

It can be observed from FIG. 7 that the amount of coupling is generally less when the width of the choke 4*a* and the choke 4*b* is more. Moreover, the amount of coupling is suppressed to minimum when the depth of the choke 4*a* and the choke 4*b* is 0.175λ, which is less than 0.25λ that was conventionally considered to be the depth of a choke at which minimum coupling is achieved. The amount of coupling between the first antenna 1 and the second antenna 2 in the second embodiment is generally less as compared to even the first embodiment. Furthermore, compared to any other value of the depth, the amount of coupling is suppressed to minimum when the depth of the choke 4*a* and the choke 4*b* is 0.175λ.

That is, if the depth of the choke 4*a* and the choke 4*b* is in the range from 0.125λ to less than 0.25λ, the amount of coupling is less than when the depth of the choke 4*a* and the choke 4*b* is 0.25λ, which was conventionally considered to be the depth of a choke at which minimum coupling is achieved. Because the approach to make the choke 0.25λ deep is known, the suppression of coupling in the antenna apparatus according to the present invention is effectively achieved when the depth of the choke 4*a* and the choke 4*b* is less than 0.225λ. When such configuration is implemented in an antenna apparatus that is located in a vacuum or air and employs a millimeter-waveband antenna apparatus of 76 gigahertz, it is preferable that the depth of the choke 4*a* and the choke 4*b* be in the range from about 0.5 mm to 0.9 mm. To further suppress the amount of coupling, the depth of the choke 4*a* and the choke 4*b* be in the range from 0.15λ to 0.2λ, that is, in the range from about 0.6 mm to 0.8 mm when located in a vacuum or in air. The reason why it is preferable that the depth of the choke 4*a* and the choke 4*b* be 0.175λ, instead of the conventional value of 0.25λ, is the same as that explained in the first embodiment, except that the depth of the choke 4*a* and the choke 4*b* is different than the choke 4 in the first embodiment.

Figure 8:
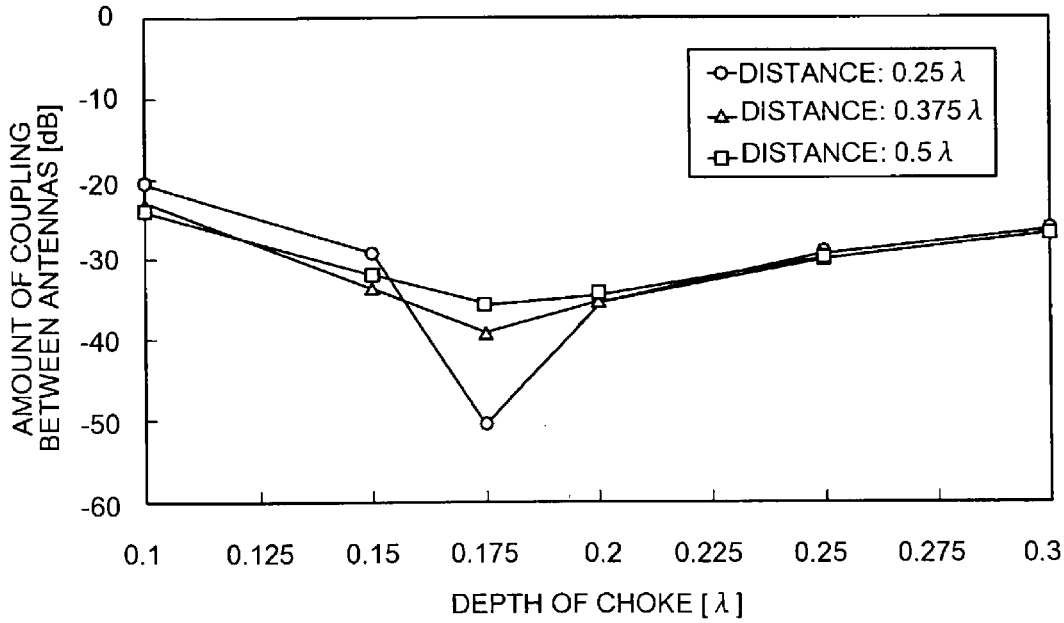
FIG. 8 is a graph depicting the variation in the amount of coupling that occurs between the first antenna 1 and the second antenna 2 depending on the depth of the choke 4*a* and the choke 4*b*, and the distance between the choke 4*a* and the choke 4*b* functioning as parameters in the antenna apparatus according to the second embodiment of the present invention.

Given bellow is the description about the relation between the amount of coupling between the first antenna 1 and the second antenna 2, and the distance between the choke 4*a* and the choke 4*b*. FIG. 8 is a graph depicting the variation in the amount of coupling between the first antenna 1 and the second antenna 2 depending on the depth of the choke 4*a* and the choke 4*b*, and the distance between the choke 4*a* and the choke 4*b* as the parameters in the antenna apparatus according to the second embodiment of the present invention. The horizontal axis represents the depth of the choke 4*a* and the choke 4*b*, while the vertical axis represents the amount of coupling between the first antenna 1 and the second antenna 2. A solid line with circles represents a graph when the distance between the choke 4*a* and the choke 4*b* is 0.25λ. A solid line with triangles represents a graph when the distance between the choke 4*a* and the choke 4*b* is 0.375λ. A solid line with squares represents a graph when the distance between the choke 4*a* and the choke 4*b* is 0.5λ.

It can be observed from FIG. 8 that the amount of coupling does not vary much relative to the distance between the choke 4*a* and the choke 4*b*, except when the depth of the choke 4*a* and the choke 4*b* is 0.175λ. When the depth of the choke 4*a* and the choke 4*b* is 0.175λ and the distance between the choke 4*a* and the choke 4*b* is 0.25λ, it can be observed that the amount of coupling between the first antenna 1 and the second antenna 2 is effectively suppressed than in any other case.

Figure 9:
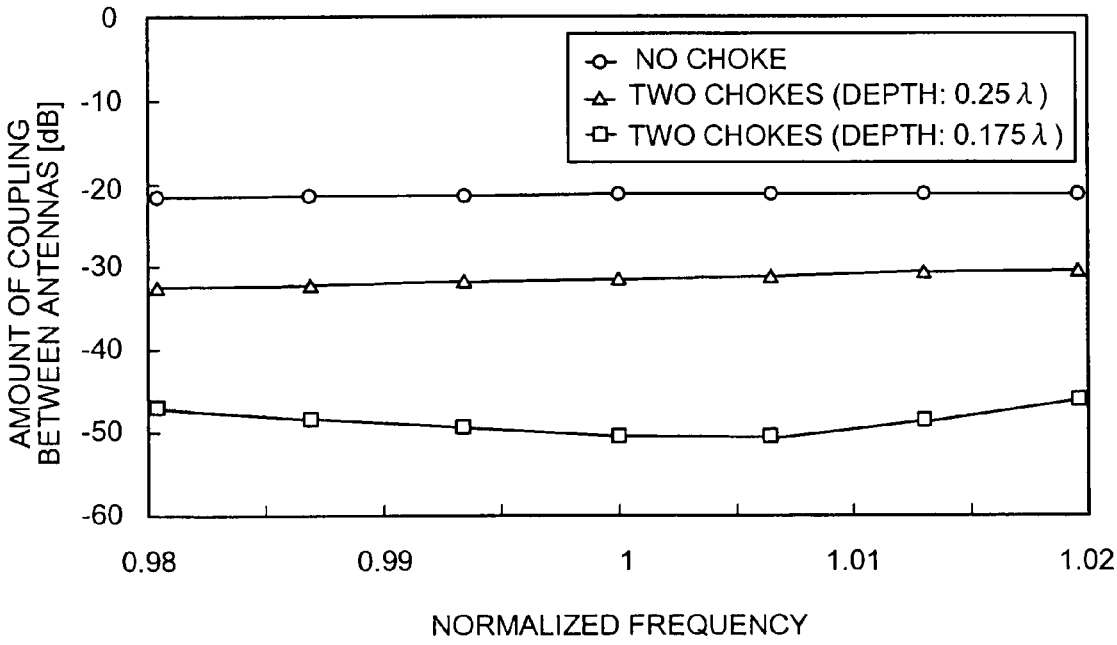
FIG. 9 is a graph depicting the variation in the amount of coupling that occurs between the first antenna 1 and the second antenna 2 depending on the depth of the choke 4*a* and the choke 4*b* functioning as a parameter in the antenna apparatus according to the second embodiment of the present invention.

FIG. 9 is a graph depicting the variation in the amount of coupling between the first antenna 1 and the second antenna 2 depending on the depth of the choke 4*a* and the choke 4*b* as the parameter in the antenna apparatus according to the second embodiment of the present invention. The width of the choke 4*a* and the choke 4*b* is 0.225λ, and the distance between the choke 4*a* and the choke 4*b* is 0.25λ. The horizontal axis represents a normalized frequency, while the vertical axis represents the amount of coupling between the first antenna 1 and the second antenna 2. A solid line with circles represents a graph when no choke is arranged between the first antenna 1 and the second antenna 2. A solid line with triangles represents a graph when the choke 4*a* and the choke 4*b* having the depth of 0.25λ are arranged. A solid line with squares represents a graph when the choke 4*a* and the choke 4*b* having the depth of 0.175λ are arranged.

As shown in FIG. 9, when no choke is arranged between the first antenna 1 and the second antenna 2, the amount of coupling between the first antenna 1 and the second antenna 2 is about −22 dB. When the choke 4*a* and the choke 4*b* having the depth of 0.25λ are arranged, the amount of coupling between the first antenna 1 and the second antenna 2 is less by about −10 dB than in the case when no choke is arranged. Moreover, when the choke 4*a* and the choke 4*b* having the depth of 0.175λ, are arranged, the amount of coupling between the first antenna 1 and the second antenna 2 is less in the range from about −15 to −20 dB than in the case when the choke 4*a* and the choke 4*b* having the depth of 0.25λ are arranged.

The horizontal axis in FIG. 9 represents the normalized frequency. When the normalized frequency is implemented in, e.g., an antenna apparatus in a millimeter-wave automotive radar and having a central frequency of 76.5 gigahertz, suppression of the coupling can be achieved in the range from about 75 gigahertz to about 78 gigahertz.

To sum up, as compared to the first embodiment, in the antenna apparatus according to the second embodiment, the choke 4*a* and the choke 4*b* are arranged in parallel between the first antenna 1 and the second antenna 2. Because of such configuration, the electromagnetic coupling between the first antenna 1 and the second antenna 2 can be suppressed more effectively. To further suppress the amount of coupling between the first antenna 1 and the second antenna 2, the distance between the choke 4*a* and the choke 4*b* be 0.25λ.

Third Embodiment

Given below is the description of a structure and a method of manufacturing the antenna apparatus according to the first embodiment or the second embodiment. The reference numerals of the components are identical to those used in the first embodiment and the second embodiment.

For example, if the antenna apparatus is implemented in a millimeter-wave automotive radar and having a frequency of 76 gigahertz, a single wavelength in a vacuum or in air is about 4 mm. Moreover, a change by 0.1 mm in the depth of the choke 4 according to the first embodiment or the choke 4*a* and the choke 4*b* according to the second embodiment corresponds to 0.025λ. Hence, to achieve minimum coupling and to keep in control the dimensional tolerance of the antenna apparatus, it is necessary to control the dimensional tolerance of the depth of the choke 4 or the choke 4*a* and the choke 4*b* within about ±0.05.

Taking into consideration the above conditions, it is difficult to use aluminum die-casting to manufacture an antenna apparatus of the configuration as described in the first embodiment or the second embodiment because of the machining work involved in later stages of manufacturing that increases the cost. Another option is to use, e.g., stainless steel plates. A plurality of stainless steel plates can be laminated together either by the method of press fitting by making use of the unevenness of each stainless steel plate or by the method of partial welding. In this way, the dimensional tolerance of each stainless steel plate can be controlled within ±0.05. However, when such a laminated stainless steel plate is used to make waveguides for the first antenna 1 and the second antenna 2, electromagnetic energy loss from interlaminar gaps in the laminated stainless steel plate causes serious functional problems. On the other hand, if an entire waveguide is subjected to welding or brazing from inside, then the problems of varied dimensions or increased cost may arise.

To solve such problems, according to the present embodiment, the stainless steel plates are subjected to diffusion bonding. Diffusion bonding is a method to bind two different metals by subjecting them to heat and pressure such that diffusion occurs between the two materials. Metallic binding occurs when the surfaces of two metals are so closely approximated that atoms of the metals come in mutual proximity. Thus, in principle, if two metals are mutually approximated, it is possible to achieve metallic binding. In case of metallic binding, there is less electromagnetic energy lost because the deformation after metallic binding is less. Hence, a waveguide can be manufactured by making a hole through metallically bound layers of different metals.

Figure 10:
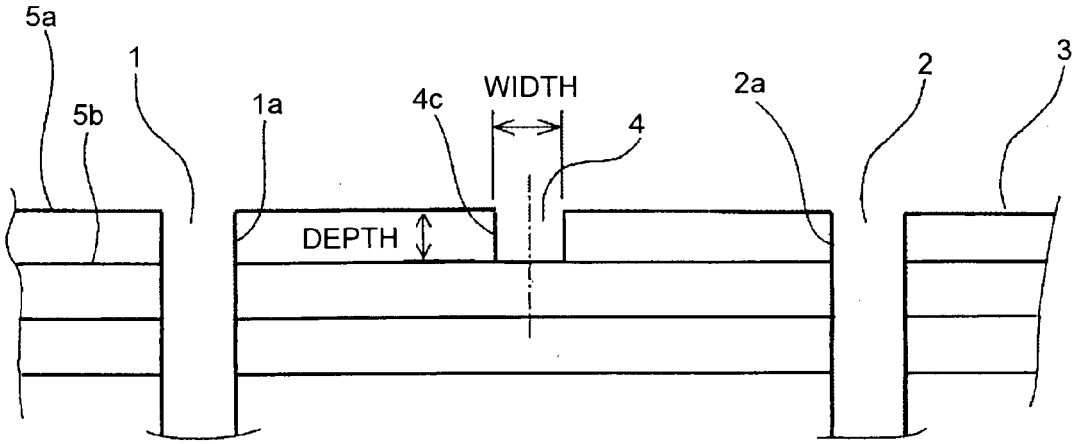
FIG. 10 is a side view of the structure of the antenna apparatus according to the first embodiment in which a method of diffusion bonding is implemented.
Figure 11:
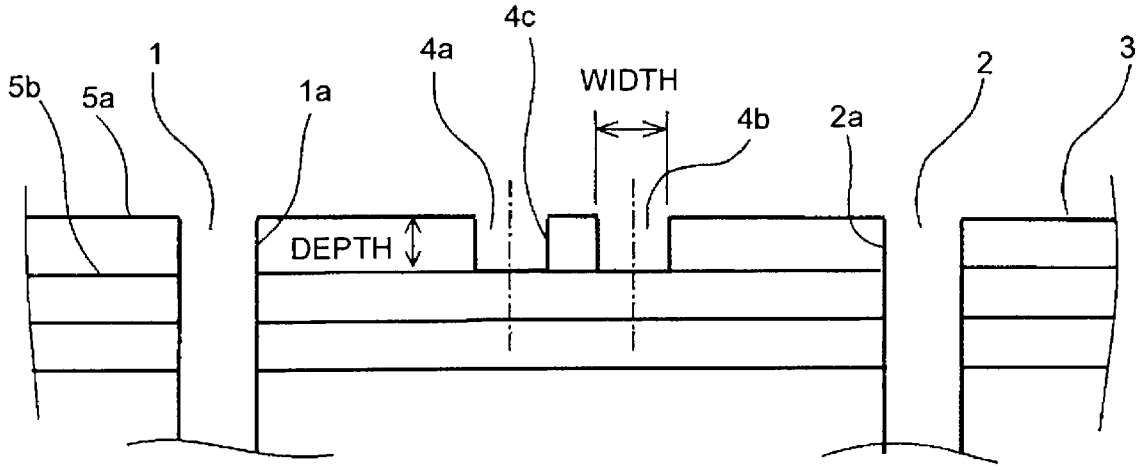
FIG. 11 is a side view of the structure of the antenna apparatus according to the second embodiment in which the method of diffusion bonding is implemented.

FIG. 10 is a cross-sectional view of the structure of the antenna apparatus according to the first embodiment in which a method of diffusion bonding is implemented. FIG. 11 is a cross-sectional view of the structure of the antenna apparatus according to the second embodiment in which the method of diffusion bonding is implemented.

Given below is the description of the structure of the antenna apparatus according to the first embodiment and the second embodiment in which the method of diffusion bonding is implemented. In the ground conductor 3 in FIGS. 10 and 11, a first steel plate 5*a* and a second steel plate 5*b* are bound by the method of diffusion bonding. On the first steel plate 5*a*, a first-antenna aperture 1*a*, a second-antenna aperture 2*a*, and a choke-4 slit 4*c* in FIG. 10, or a choke-4*a* slit 4*c* and a choke-4*b* slit 4*c* in FIG. 11 are arranged. The first-antenna aperture 1*a* and the second-antenna aperture 2*a* also pass through the second steel plate 5*b*.

The depth of the choke 4 in FIG. 10, and the depths of the choke 4*a* and the choke 4*b* in FIG. 11 are equal to the thickness of a single steel plate. As a result, any dimensional error occurring due to binding two steel plates does not affect the choke 4, the choke 4*a*, and the choke 4*b*. When such a structure is implemented in, e.g., an antenna apparatus in a millimeter-wave automotive radar and having a frequency of 76 gigahertz, the thickness of a steel plate according to the first embodiment is 0.8 mm, while the thickness of a steel plate according to the second embodiment is 0.7 mm. Moreover, the number of the steel plates that are subjected to diffusion bonding can be altered to match with the optimum depth of the choke 4, the choke 4*a*, and the choke 4*b*.

To sum up, the ground conductor 3 includes the first steel plate 5*a* and the second steel plate 5*b* that are bound by the method of diffusion bonding. On the first steel plate 5*a*, the first-antenna aperture 1*a*, the second-antenna aperture 2*a*, and the choke-4 slit 4*c*, or the choke-4*a* slit 4*c* and the choke-4*b* slit 4*c* are arranged. Through the second steel plate 5*b*, a first waveguide, i.e., the first-antenna aperture 1*a* and a second waveguide, i.e., the second-antenna aperture 2*a* pass. By implementing such structure in the antenna apparatus, the amount of coupling between the first antenna 1 and the second antenna 2 is suppressed. Moreover, each of the first antenna 1 and the second antenna 2 is connected to a separate waveguide from which less electromagnetic energy is lost.

INDUSTRIAL APPLICABILITY

An antenna apparatus and a method of manufacturing the antenna apparatus according to the present invention is suitable for effectively suppressing the amount of coupling between a transmitting antenna and a receiving antenna.

The invention claimed is:

1. An antenna apparatus that operates in millimeter waveband or microwave band, the antenna apparatus comprising:

a ground conductor;

a transmitting antenna arranged on the ground conductor and connected to a first feed line;

a receiving antenna arranged on the ground conductor and connected to a second feed line; and one or more chokes that are arranged on the ground conductor between the transmitting antenna and the receiving antenna, and are operative to suppress an electromagnetic coupling between the transmitting antenna and the receiving antenna, wherein is all of the one or more chokes are in a form of a groove which has a bottom surface at a depth below an opening in the ground conductor, and the depth of the bottom surface is in a range from 0.15λ to less than 0.225λ, where λ is a wavelength of a carrier wave of the transmitting antenna.

2. The antenna apparatus according to claim 1, wherein the one or more chokes are a plurality of chokes which are arranged in plurality and parallel to each other.

3. The antenna apparatus according to claim 2, wherein a distance between adjoining chokes is about 0.25λ.

4. The antenna apparatus according to claim 3, further comprising:

a first metal plate that forms a top layer of the ground conductor and on which a transmitting antenna aperture, a receiving antenna aperture, and a choke slit are arranged; and a second metal plate that is bound with the first metal plate by a method of diffusion bonding and through which the transmitting antenna aperture and the receiving antenna aperture pass.

5. The antenna apparatus according to claim 2, wherein the depth of the bottom surface is in a range from 0.15λ to 0.2λ.

6. The antenna apparatus according to claim 5, further comprising:

a first metal plate that forms a top layer of the ground conductor and on which a transmitting antenna aperture, a receiving antenna aperture, and a choke slit are arranged; and a second metal plate that is bound with the first metal plate by a method of diffusion bonding and through which the transmitting antenna aperture and the receiving antenna aperture pass.

7. The antenna apparatus according to claim 2, further comprising:

a first metal plate that forms a top layer of the ground conductor and on which a transmitting antenna aperture, a receiving antenna aperture, and a choke slit are arranged; and a second metal plate that is bound with the first metal plate by a method of diffusion bonding and through which the transmitting antenna aperture and the receiving antenna aperture pass.

8. The antenna apparatus according to claim 1, further comprising:

a first metal plate that forms a top layer of the ground conductor and on which a transmitting antenna aperture, a receiving antenna aperture, and a choke slit are arranged; and a second metal plate that is bound with the first metal plate by a method of diffusion bonding and through which the transmitting antenna aperture and the receiving antenna aperture pass.

9. The antenna apparatus according to claim 1, wherein there exists only a single choke between the transmitting antenna and the receiving antenna.

10. The antenna apparatus according to claim 9, wherein the single choke is located at a central point between the transmitting antenna and the receiving antenna.

11. The antenna apparatus according to claim 1, wherein a distance from the receiving antenna to the transmitting antenna is an integral multiple of λ.

12. The antenna apparatus according to claim 1, wherein the transmitting antenna extends in a first direction, the receiving antenna extends in the first direction parallel to the transmitting antenna, and the one or more chokes extend in the first direction parallel to the transmitting and receiving antennas so as to extend beyond the transmitting and receiving antennas in the first direction.

13. The antenna apparatus according to claim 1, wherein the groove has a width in a range from 0.15λ to 0.3λ.

14. A method of manufacturing an antenna apparatus that operates in millimeter waveband or microwave band, the method comprising:

manufacturing a first metal plate that has a thickness in a range from 0.15λ to less than 0.225λ wherein λ is a wavelength of a carrier wave, and includes a ground conductor, and on which a transmitting antenna aperture, a receiving antenna aperture, and one or more choke grooves with a bottom surface below an opening in the ground conductor and all of the one or more chokes having a depth corresponding to the thickness of the first metal plate are arranged;

manufacturing a second metal plate through which the transmitting antenna aperture and the receiving antenna aperture pass; and applying diffusion bonding to the first metal plate and the second metal plate by matching a corresponding position of the transmitting antenna and the receiving antenna aperture.

* * * * *